US007059000B2

(12) United States Patent
Verbovszky

(10) Patent No.: US 7,059,000 B2
(45) Date of Patent: Jun. 13, 2006

(54) PORTABLE INFANT CUSHION

(76) Inventor: Esther A. L. Verbovszky, 325 N. Falmouth Dr., Rocky River, OH (US) 44116

( * ) Notice: Subject to any disclaimer, the term of this patent is extended or adjusted under 35 U.S.C. 154(b) by 0 days.

(21) Appl. No.: 10/917,105

(22) Filed: Aug. 12, 2004

(65) Prior Publication Data

US 2005/0005362 A1 Jan. 13, 2005

Related U.S. Application Data

(63) Continuation-in-part of application No. 10/120,089, filed on Apr. 10, 2002, now Pat. No. 6,848,128.

(51) Int. Cl.
*A47D 13/06* (2006.01)

(52) U.S. Cl. ..... 5/655; 5/99.1

(58) Field of Classification Search ..... 5/93.1, 5/655, 93.2, 94, 98.1, 628
See application file for complete search history.

(56) References Cited

U.S. PATENT DOCUMENTS

| | | | | |
|---|---|---|---|---|
| 2,626,407 | A | 1/1953 | Kurry | |
| 3,321,779 | A | 5/1967 | Kaufman et al. | |
| 3,803,646 | A | 4/1974 | Newerowski | |
| 3,968,911 | A * | 7/1976 | Haas | 224/158 |
| 4,281,425 | A * | 8/1981 | Jacobs | 5/676 |
| 4,583,253 | A | 4/1986 | Hall | |
| 4,712,258 | A * | 12/1987 | Eves | 5/424 |
| 4,788,726 | A | 12/1988 | Rafalko | |
| 5,014,376 | A | 5/1991 | Doran et al. | |
| 5,153,954 | A | 10/1992 | Ohman | |
| 5,341,530 | A | 8/1994 | Ward | |
| 5,345,622 | A | 9/1994 | Plone | |
| 5,551,108 | A | 9/1996 | Butler, III | |
| 5,551,109 | A * | 9/1996 | Tingley et al. | 5/655 |
| 5,561,876 | A | 10/1996 | Petruzella | |
| 5,699,569 | A | 12/1997 | Schwarz-Zohrer | |
| 5,937,465 | A | 8/1999 | Carew et al. | |
| 6,026,525 | A | 2/2000 | Davis | |
| 6,370,715 | B1 | 4/2002 | Morton | |
| 6,389,624 | B1 * | 5/2002 | Madole | 5/655 |
| 6,446,290 | B1 | 9/2002 | Gidtske | |
| 6,490,741 | B1 | 12/2002 | Wheeler | |
| 6,505,366 | B1 | 1/2003 | Lied | |
| 6,912,743 | B1 * | 7/2005 | Weil | 5/93.1 |

* cited by examiner

*Primary Examiner*—Michael Trettel
(74) *Attorney, Agent, or Firm*—Tarolli, Sundheim, Covell & Tummino L.L.P.

(57) ABSTRACT

A portable infant cushion (10) includes a base (12) having a top surface (14) for engaging the body of an infant placed onto the top surface and for transferring the weight of the infant. The top surface (14) includes a head support portion (20) non-releasably attached to the base (12) and having a head engaging surface elevated relative to the base for supporting the head of the infant. The top surface (14) includes a body support portion (18) connected to the base (12) which is longitudinally spaced from the head support (20) and is for supporting the body of an infant. A side wall (24) extends peripherally around the base (12) and having an elevated surface elevated higher than the head support (20). The cushion (10) includes a blanket (32) for covering the infant adapted to be placed on the top surface (14). The blanket (32) has at least a portion secured to the side wall (24). The blanket (32) is extensible over the top surface (14) without extending over the head support portion (20).

14 Claims, 8 Drawing Sheets

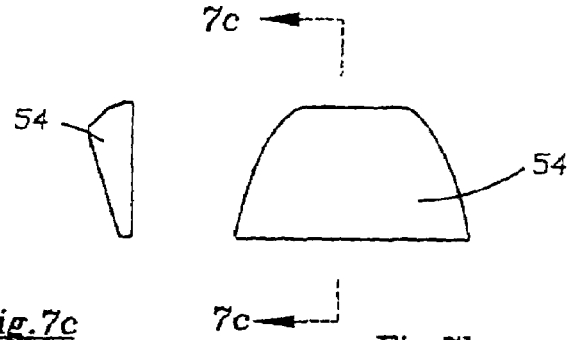
Fig.7c
Fig.7b
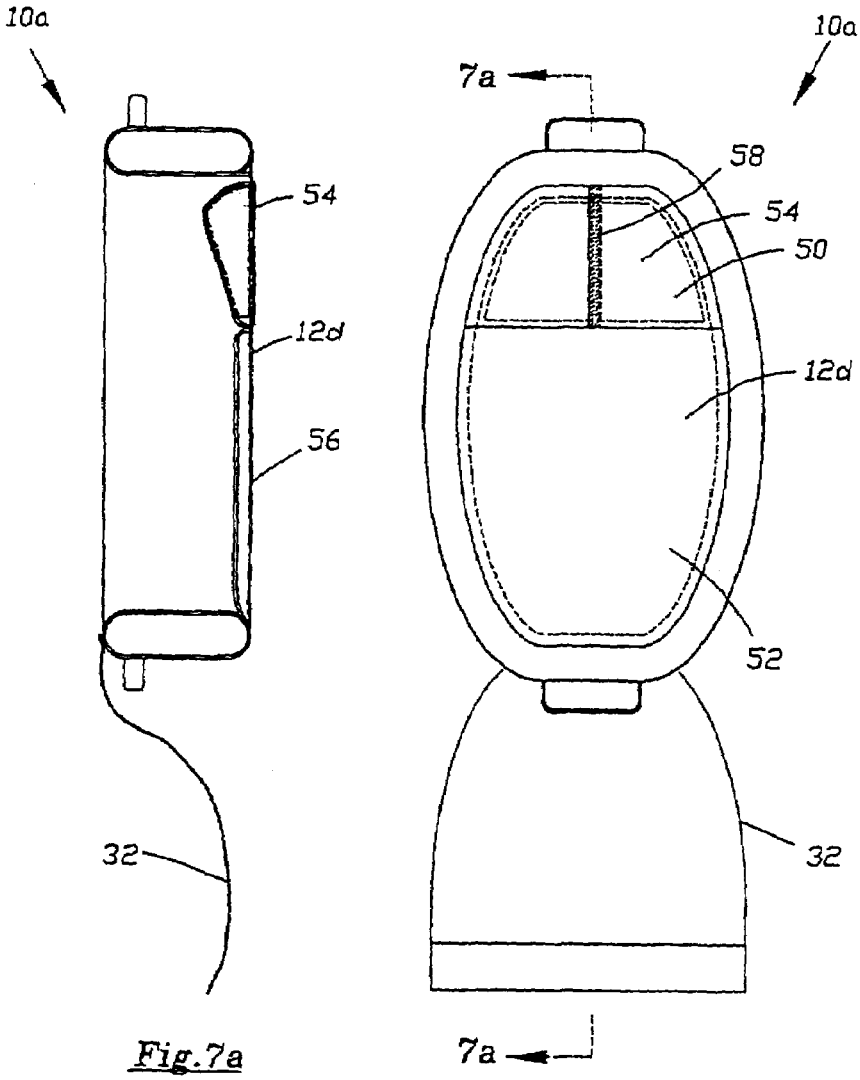
Fig.7a
Fig.7

PORTABLE INFANT CUSHION

The application is a Continuation-In-Part application of U.S. patent application Ser. No. 10/120,089, filed Apr. 10, 2002 now issued as U.S. Pat. No. 6,848,128.

TECHNICAL FIELD

The present invention relates to a portable infant cushion, and particularly to a portable infant cushion with an integrated blanket and pillow.

BACKGROUND OF THE INVENTION

It is common for infants to sleep in cribs, bassinets, baby carriers, car seats, baby buggies or strollers. It is also common for infants to sleep with a pillow and a blanket. An infant's physical safety and emotional comfort while sleeping is of particular concern. The pillow and blanket are potentially harmful items to an infant while sleeping. The infant may unconsciously pull the blanket over his/her head or roll underneath the pillow and suffocate while sleeping.

In addition, studies have shown that infants breathe better when the infant's head is elevated higher than the rest of their body when they are in a supine position so that a pillow provides added physiological benefits to the infant.

Traveling with infants is often difficult because of the amount of accompanying paraphernalia that is required. In addition, many required items are used only for short periods of time since infants quickly outgrow these items. Infant gear which is adjustable in size in response to the increasing growth of the infant as the infant ages retains usefulness longer and is a better investment for caregivers.

SUMMARY OF THE INVENTION

A portable infant cushion includes a base having a top surface for engaging the body of an infant placed onto the top surface and for transferring the weight of the infant. The top surface includes a head support portion non-releasably attached to the base and having a head engaging surface elevated relative to the base for supporting the head of the infant. The top surface includes a body support portion connected to the base and is longitudinally spaced from the head support for supporting the body of an infant. A side wall extends peripherally around the base and has an elevated surface elevated preferably higher than the head support. However, the surface of the side wall may be elevated to the same height as the head support or less than the height of the head support.

The cushion includes a blanket for covering the infant adapted to be placed on the top surface. The blanket has at least a portion secured to the side wall. The blanket extends over the top surface without extending over the head support portion.

BRIEF DESCRIPTION OF THE DRAWINGS

The foregoing and other features of the present invention will become apparent to those skilled in the art to which the present invention relates upon reading the following description with reference to the accompanying drawings, in which:

FIG. 7 is a schematic bottom view of a portable infant cushion according to a fifth embodiment with parts removed for clarity;

FIG. 7*a* is a cross-sectional view of the portable infant cushion taken along the lines 7*a*—7*a* of FIG. 7;

FIG. 7*b* is a schematic plan view of a portion of the portable infant cushion of FIG. 7*a;*

FIG. 7*c* is a cross-sectional view of a portion of the portable infant cushion taken along the lines 7*c*—7*c* of FIG. 7*b;*

DETAILED DESCRIPTION OF THE INVENTION

Figure 1:
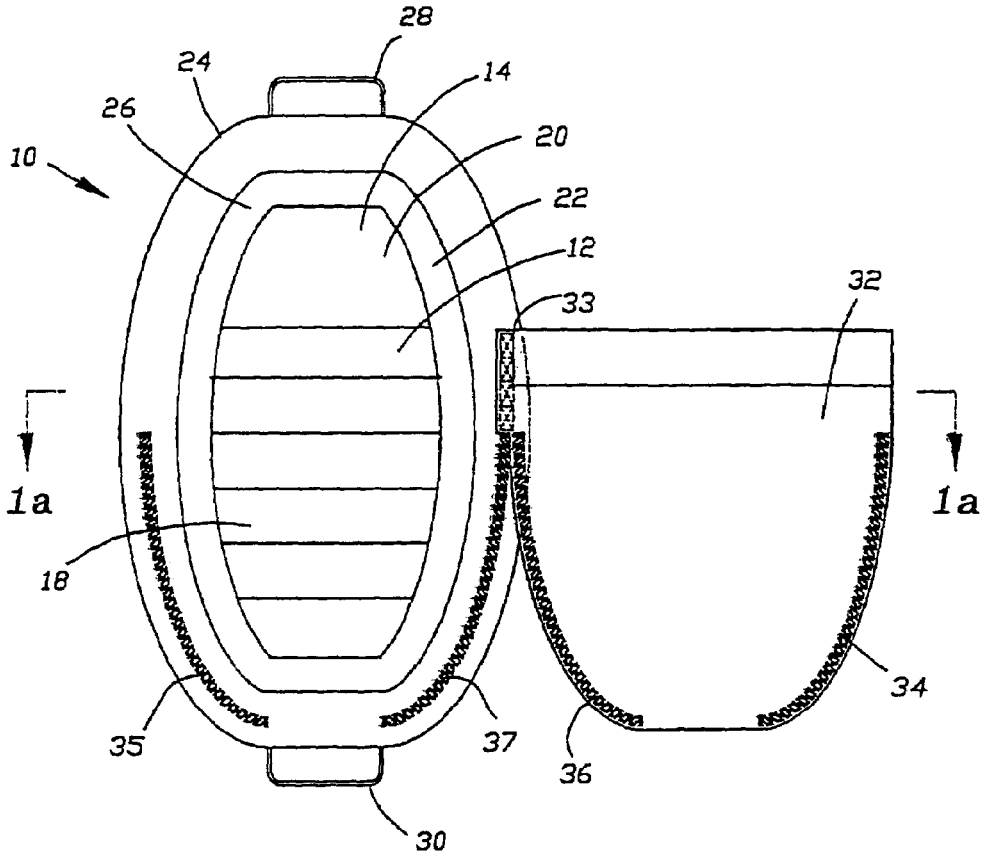
FIG. 1 is a schematic plan view of a portable infant cushion embodying the present invention.
Figure 1A:
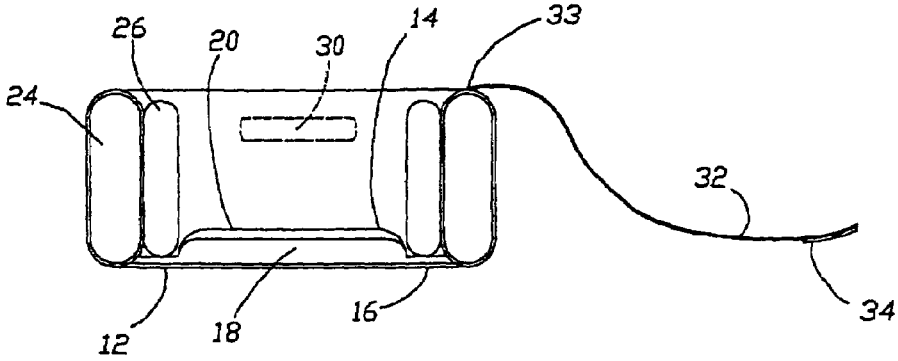
FIG. 1*a* is a side view of the portable infant cushion of FIG. 1.

The present invention relates to a portable infant cushion. The infant cushion 10 is illustrated in FIGS. 1–1*a*. The infant cushion 10 has a generally oval shape. The infant cushion 10 also has a planar base 12 made of a thin layer of cushion material. The base 12 has a top surface 14 for engaging and supporting an infant placed onto the cushion 10. The base 12 also has a bottom surface 16 opposite the top surface. The base 12 is a resilient structure preferably made of a French terry cloth material filled with batting. Specifically, the base 12 is a thin layer of batting between two layers of French terry cloth material. French terry cloth consists of 80% cotton/20% polyester fiber. The batting is preferably a flame retardant 100% polyester material. A removable washable cover may also envelope the base 12.

A body support 18 is secured to the top surface 14 of the base 12. The body support 18 is a separate structure which is a layer of batting between two layers of French terry cloth material. The body support 18 is sewn onto the top surface 14 of the base 12. Several sew lines are schematically illustrated on the body support 18 in FIG. 1. The sew lines extend transverse to a longitudinal direction of the cushion 10. The body support 18 has a surface which is elevated higher than the top surface 14 of the base 12. The body support 18 is a half-oval shape.

A head support or pillow 20 is sewn to the top surface 14 of the base 12 adjacent the body support 18. The pillow 20 is also a separate structure and is made of several layers of batting between two layers of French terry cloth material. The pillow 20 has a surface which is elevated higher than the surface of the body support 18. The pillow 20 and body support 18 are for supporting the head and body of an infant lying supine on the cushion 10. The pillow 20 and the body support 18 are integral with the base 12.

The pillow 20, body support 18, and base 12 are preferably made of French terry cloth material filled with batting. Instead of French terry cloth, the material of the pillow 20 and the body support 18 may be any suitable equivalent textile material such as cotton, polyester, wool, fleece, or a combination thereof. Instead of batting, the pillow 20 and body support 18 can be filled with foam or gel or other suitable material or can be inflated with water or air. The material of the body support 18 and the pillow 20 may also be made of a cushioning media such as a flame retardant foam rubber or foam vinyl covered with a suitable washable skin made of hypoallergenic plastic, nylon, polyurethane or any suitable material. The cushioning media may have skin manufactured with a nylon facing and a backing of a 65%/35% combination of polyester and cotton. The foam used in the manufacture of the pillow 20 and the body support 18 can also be a particular type of foam known as "memory foam". Memory foam retains the shape of an object which is pressed onto it. For example, memory foam can retain the body shape of a premature infant who is placed on the foam. The entire infant cushion 10 is washable.

The base 12 includes an area which defines a boundary 22 around the body support 18 and pillow 20. A side wall 24 is attached to the periphery of the base 12 at the boundary 22. The side wall 24 has a surface which is elevated higher than the surface of the pillow 20 and the body support 18. The boundary 22 extends between both the side wall 24 and the body support 18 as well as the side wall 24 and the pillow 20. The side wall 24 is a unitary tube-shaped cushion having a ring structure and which is attached to the periphery of the base 12 by sewing. Instead of attaching the side wall 24 to the base 12 by sewing, the side wall 24 can alternatively be attached to the base by fasteners such as snaps, buttons, zippers, hooks, glue etc.

Figure 4:
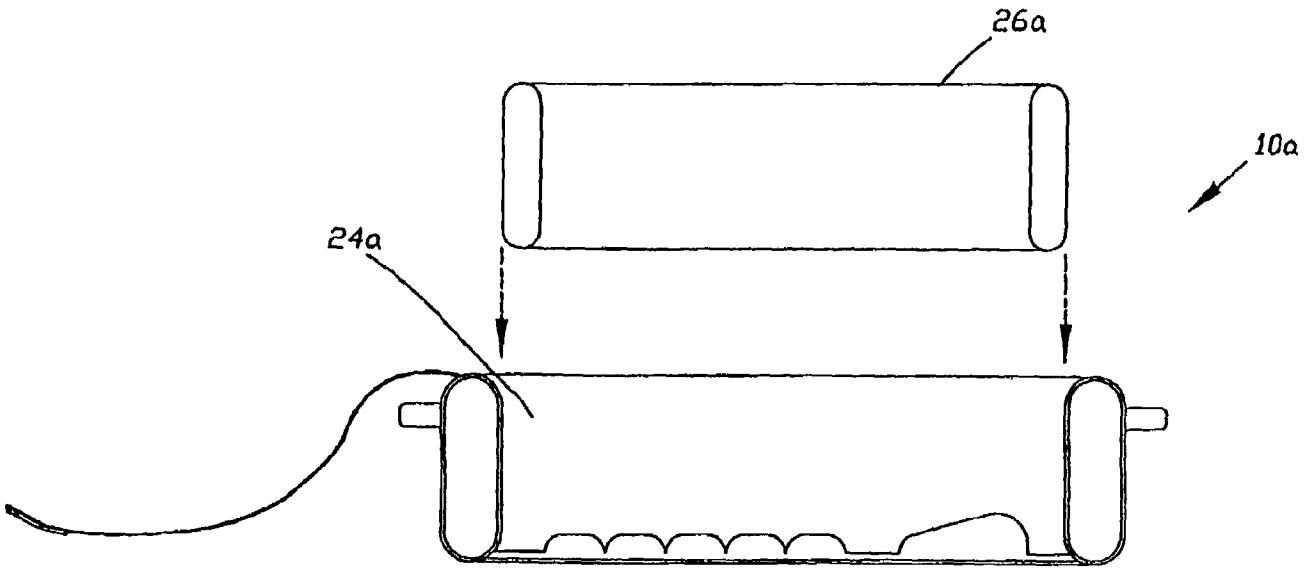
FIG. 4 is an exploded view of the portable infant cushion of FIG. 2*a;*

A removable ring-shaped cushion insert 26 is for location on the boundary 22. The ring insert 26 is a separate structure identical to the side wall 24. The ring insert 26 is an unitary tube-shaped cushion having a ring structure. The ring insert 26 is optionally inserted into the cushion 10 onto the boundary 22 on the base 12 between the side wall 24 and the body support 18 and pillow 20 (FIG. 4). The ring insert 26 is removable.

Both the side wall 26 and the ring insert 26 are preferably made of a tube of French terry cloth material filled with batting. Instead of French terry cloth, the material of the base 12, the side wall 24 and the ring insert 26 may be any suitable equivalent textile material such as cotton, polyester, wool, fleece, or a combination thereof. Also, the batting may be of a suitable material other than polyester materials.

The ring insert 26, when placed on the boundary 22, reduces the surface area of the base 12 on which the infant can lie and provides an additional wall of cushion material. The purpose of the ring insert 26 is to make the cushion 10 adjustable with the growth of the infant. If desired, the ring insert 26 can be placed onto the boundary 22 on the base 12 when the infant is smaller in size, for example, when the infant is a new born or an infant who is born premature. Similarly, when the infant grows to a larger size, the ring insert 26 can be removed from the cushion 10 which increases the surface area upon which the infant can lie. Thus, the cushion 10 can comfortably accommodate a smaller size infant as well as a larger size infant.

A pair of handles 28, 30 (FIG. 1) are non-releasably attached to the side wall 24 at opposite ends of the cushion 10. The handles 28, 30 are for transporting the cushion 10. In the embodiment according to FIG. 1, one handle 28 is located on the side wall 24 adjacent the pillow 20 and the other handle 30 is located on the side wall 24 adjacent the body support 18 where the infant's feet would be located.

In the embodiments, according to FIGS. 1–4, a blanket 32 is integrated with the cushion 10 by sewing a portion of the blanket to the side wall 24. This portion of the blanket 32 (indicated at reference number 33) is non-releasably attached to the side wall 24.

Portions 34, 36 of the blanket 32 are also releasably secured to portions 35, 37 of the side wall 34. The blanket 32 and the side wall 24 are provided with Velcro™ at specific mating portions 34, 35 and 36, 37 to releasably secure these portions together (FIG. 1). The blanket 32 has a half-oval shape and corresponds to the oval shape of the cushion.

The blanket 32 is preferably made of French terry cloth material. However, the blanket can be made of fleece or other similar material. The blanket 32 extends across the body support 18 up to the pillow 20 but does not extend over the pillow. The blanket 32 additionally does not extend over the head of the infant when the infant is placed onto the cushion 10. Furthermore, the infant cannot pull the blanket 32 up over his/her head since it is secured to the side wall 24 by the Velcro™. Instead of Velcro™, the blanket 32 and the side wall 24 can be releasably secured together by, for example, snaps, clips, catches, hook and eye closures, buttons and zippers.

In the embodiment according to FIG. 1, the cushion 10 is approximately 4 inches in total height, 15 inches in total width and 30 inches in total length. The side wall 24 is approximately 4 inches in height and 2 inches think. The height and thickness of the side wall 24 and the insert ring 26 are equal (FIG. 4). The height of the pillow 20 is five times the thickness of the base 12. The thickness of the body support 18 is twice the thickness of the base 12. It is to be understood that various dimensions can be used according to the desire of the manufacturer for different size infants. For example, the cushion 10 can range in total height from approximately 3.5–4 inches in total height, 12–15 inches in total width and 23–30 inches in total length. The side wall 24 can range in height from approximately 3.5–4 inches and can range in thickness from 2–3.5 inches. The height and thickness of the side wall 24 and the ring insert 26 also can be unequal.

Figure 3:
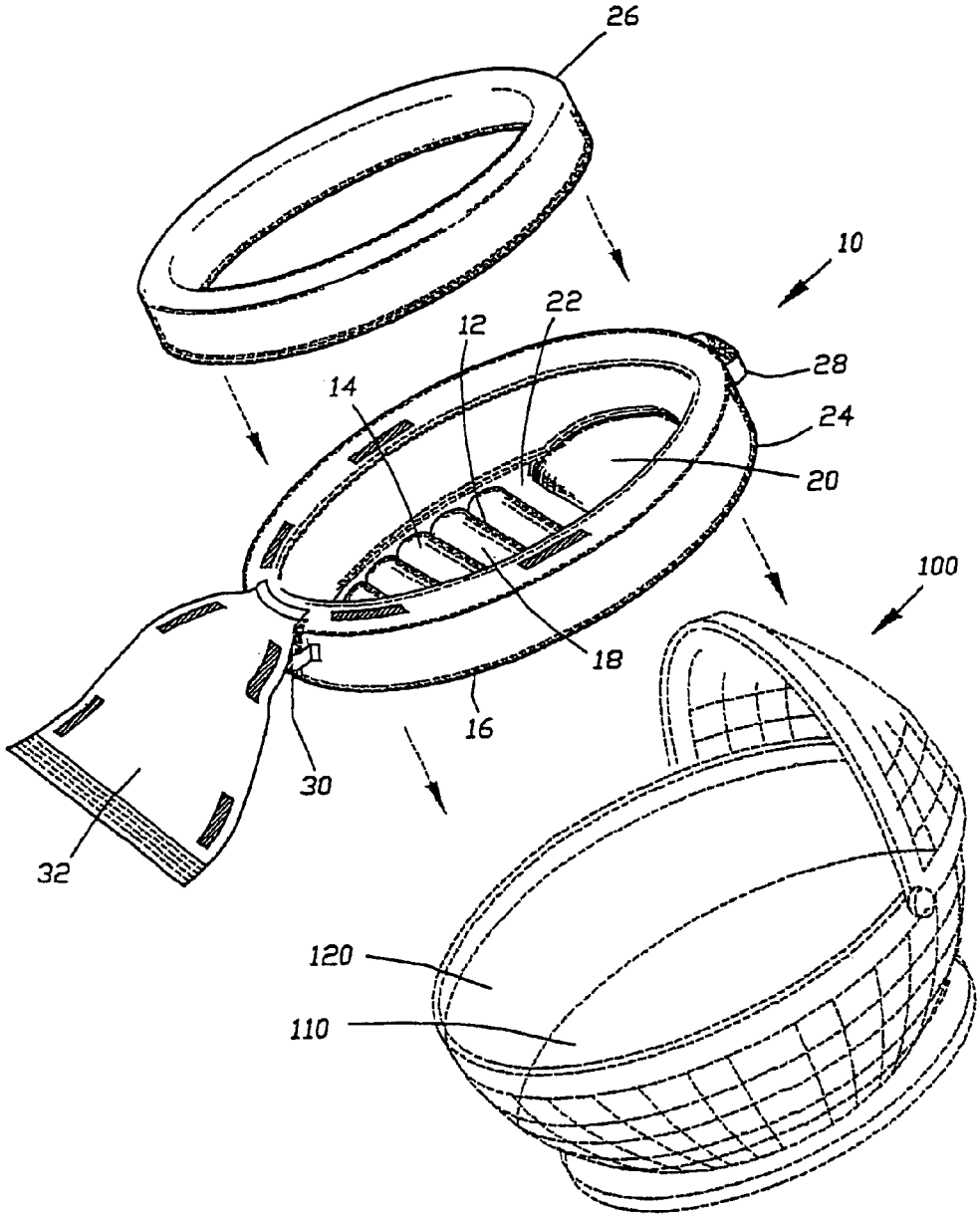
FIG. 3 is a schematic exploded view of the portable infant cushion of FIG. 1 illustrated with a schematic illustration of a baby bassinet.

FIG. 3 illustrates an exploded view of the portable infant cushion 10 according to FIG. 1 and the removable ring insert 26 for insertion into a bassinet 100. The bassinet 100 is illustrated in a schematic view and can have any similar construction. The bassinet 100 does not form any part of the invention. The bassinet 100 includes a flat bed portion 110 and a barrier portion 120 extending upwardly from the perimeter of the bed portion.

Upon assembly, if desired, the ring insert 26 is first inserted into the cushion 10. The cushion 10 is then inserted into the bassinet 100 so that the bottom surface 16 of the base 12 of the cushion 10 engages the bed portion 110 of the bassinet 100 and an outer surface of the side wall 24 of the cushion 10 engages the barrier portion 120 of the bassinet. An infant (not shown) is then placed supine into the portable infant cushion 10 so that the head of the infant rests on the pillow 20 and the body of the infant rests on the body support 18. Finally, the blanket 32 is releasably attached to the side wall 24 via Velcro™ or other means. The side wall 24 and the ring insert 26 extend around the infant at a height which is higher than the infant to prevent the infant from rolling over the side wall 24 and out of the cushion 10.

The cushion 10 advantageously reduces the space available inside the bassinet 100 for placement of an infant. The cushion 10 additionally provides a more comfortable and more cushioned sleeping environment for an infant than the bassinet 100 by itself. Also, if the ring insert 26 is inserted into the cushion 10, the top surface area 14 of the cushion is advantageously reduced even more to accommodate a smaller size infant.

Figure 2:
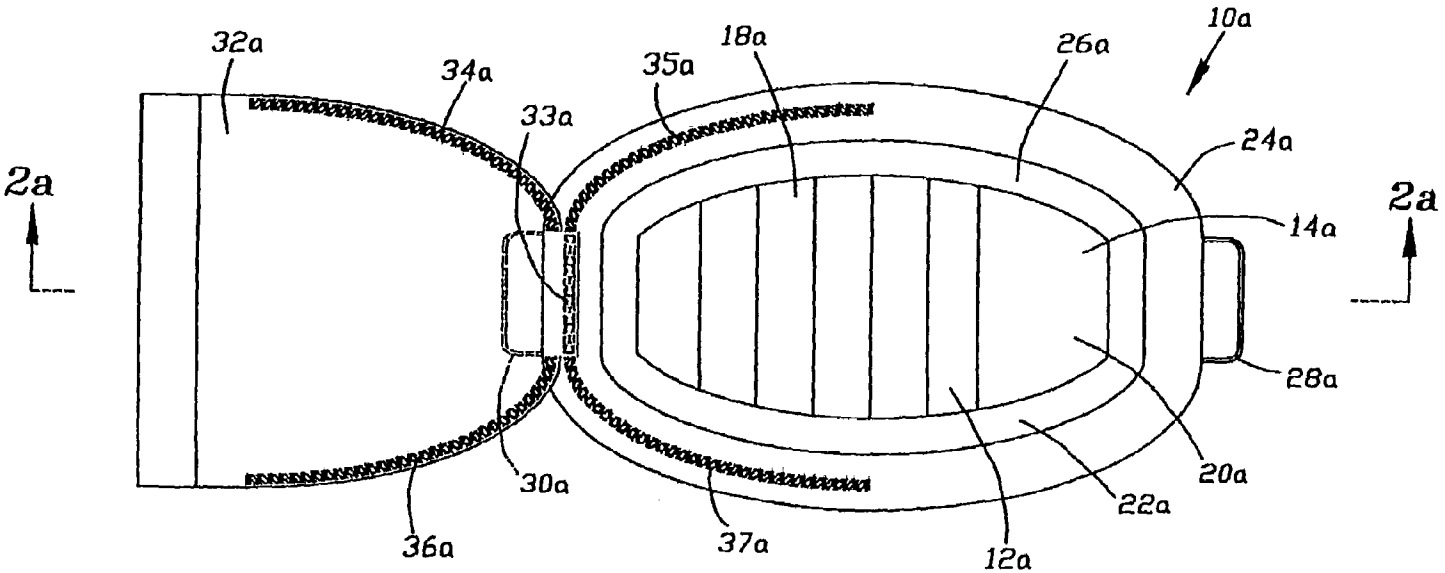
FIG. 2 is a schematic plan view of a portable infant cushion according to a second embodiment.
Figure 2A:
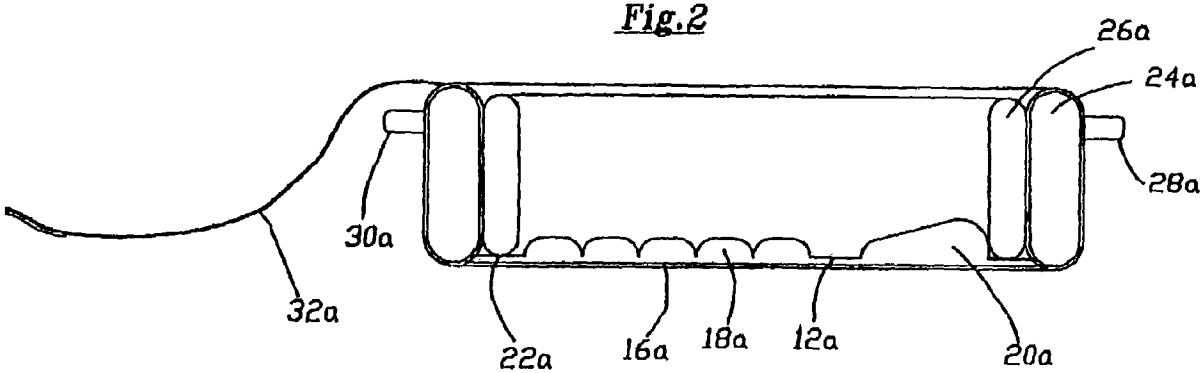
FIG. 2*a* is a cross-sectional view of the portable infant cushion taken along the lines 2*a*—2*a* of FIG. 2.

FIGS. 2–2*a* illustrate a second embodiment of the portable infant cushion. The cushion 10*a* is similar to the cushion 10 and parts that are the same or similar are given the same reference numerals with the suffix "a" attached. The infant cushion 10*a* has a generally oval shape. The infant cushion 10*a* also has a planar base 12*a* made of a thin layer of cushion material. The base 12*a* has a top surface 14*a* for engaging and supporting an infant placed onto the cushion and an opposing bottom surface 16*a*.

A body support 18*a* is secured to the top surface 14*a* of the base 12*a*. A head support or pillow 20*a* is secured to the top surface 14*a* of the base 12*a*. The pillow 20*a* has a surface which is elevated higher than the body support 18*a*. The pillow 20*a* and the body support 18*a* are for supporting the head and body of an infant lying supine on the cushion 10*a*.

The base 12*a* includes an area which defines a boundary 22*a* around the body support 18*a* and the pillow 20*a*. A side wall 24*a* is attached to the periphery of the base 12*a* at the boundary 22*a*. The side wall 24*a* is a tube-shaped cushion. The side wall 24*a* has a surface which is elevated higher than the pillow 20*a* and the body support 18*a*. The boundary 22*a* extends between the side wall 24*a* and the body support 18*a* and between the side wall 24*a* and the pillow 20*a*.

A removable ring-shaped cushion insert 26*a* is for location on the boundary 22*a*. The ring insert 26*a* is identical to the side wall 24*a*. The ring insert 26*a*, when placed on the boundary 22*a*, reduces the surface area of the base 12*a* on which the infant can lie (FIG. 2*a*).

A pair of handles 28*a*, 30*a* are non-releasably attached to the side wall 24*a* at opposite ends of the cushion 10*a*. The handles 28*a*, 30*a* are for transporting the cushion 10*a*. In the embodiment according to FIG. 1, one handle 28*a* is located on the side wall 24*a* adjacent the pillow 20*a* and the other handle 30*a* is located on the side wall 24*a* adjacent the body support 18*a* where the infant's feet would be located.

Similar to the embodiment shown in FIGS. 1–1*a*, the embodiment in FIGS. 2–2*a*, show a portion of the blanket 32*a* (illustrated at reference number 33*a*) which is non-releasably attached to the side wall 24*a*. However, an alternate location where the blanket 32*a* is attached to the side wall 24*a* is shown. The blanket 32*a* is sewn to the side wall 24*a* in the region located adjacent where the infant's feet would be located. The blanket 32*a* is non-releasably secured to the side wall 24*a* at the sewn portion.

Portions 34*a*, 36*a* of the blanket 32*a* are also releasably secured to portions 35*a*, 37*a* of the side wall 24*a*. Instead of Velcro™ shown in FIGS. 1–1*a*, the blanket 32*a* shown in FIGS. 2–2*a* is releasably secured to the side wall 24*a* by a zipper. The blanket 32*a* and the side wall 24*a* are provided with the zipper at specific mating portions to releasably secure these portions together (FIG. 2).

Similar to the embodiment shown in FIG. 1, the embodiment in FIGS. 2–2*a* show the blanket 32*a* extending across the body support 18*a* up to the pillow 20*a* but the blanket does not extend over the pillow nor the head of the infant when the infant is placed into the cushion 10*a* and covered by the blanket. The infant cannot pull the blanket 32*a* up over his/her head since it is secured to the side wall 24*a* by the zipper.

Figure 5:
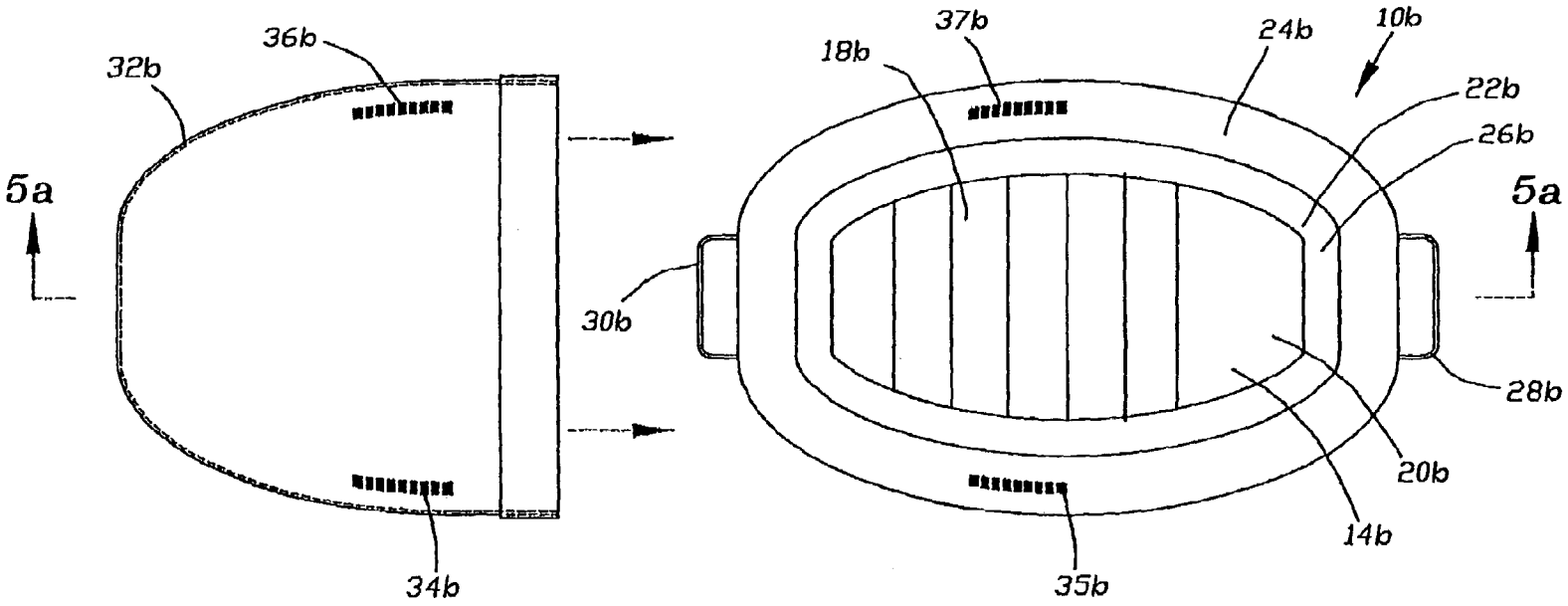
FIG. 5 is a schematic plan view of the portable infant cushion according to a third embodiment.
Figure 5A:
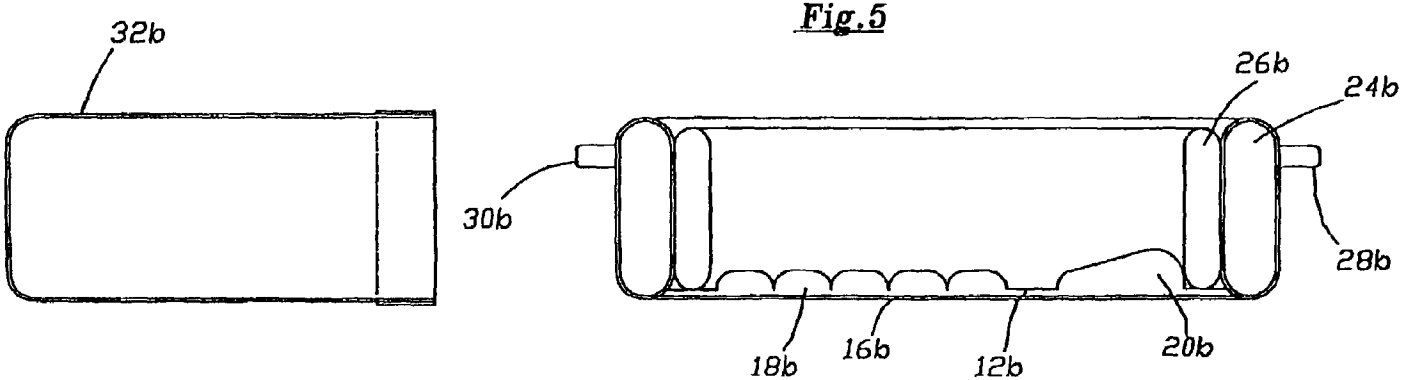
FIG. 5*a* is a cross-sectional view of the portable infant cushion taken along the lines 5*a*—5*a* of FIG. 5.

FIGS. 5–5*a* illustrate a third embodiment of the portable infant cushion. The cushion 10*b* is similar to the cushion 10, and parts that are the same or similar are given the same reference numerals with the suffix "b" attached. The infant cushion 10*b* has a generally oval shape. The infant cushion 10*b* also has a planar base 12*b* made of a thin layer of cushion material. The base 12*b* has a top surface 14*b* for engaging and supporting an infant placed onto the cushion 10*b* and an opposing bottom surface 16*b*.

A body support 18*b* is secured to the top surface 14*b* of the base 12*b*. A head support or pillow 20*b* is secured to the top surface 14*b* of the base 12*b*. The pillow 20*b* has a surface which is elevated higher than the body support 18*b*. The pillow 20*b* and the body support 18*b* are for supporting the head and body of an infant lying supine on the cushion 10*b*.

The base 12*b* includes an area which defines a boundary 22*b* around the body support 18*b* and the pillow 20*b*. A side wall 24*b* is attached to the periphery of the base 12*b* at the boundary 22*b*. The side wall 24*b* is a tube-shaped cushion. The side wall 24*b* has a surface which is elevated higher than the pillow 20*b* and the body support 18*b*. The boundary 22*b* extends between both the side wall 24*b* and the body support 18*b* and between the side wall 24*b* and the pillow 20*b*.

A removable ring-shaped cushion insert 26*b* is for location on the boundary 22*b*. The ring insert 26*b* is identical to the side wall 24*b*. The ring insert 26*b*, when placed on the boundary 22*b*, reduces the surface area of the base 12*b* on which the infant can lie (FIG. 5*a*).

A pair of handles 28*b*, 30*b* (FIG. 5) are non-releasably attached to the side wall 24*b* at opposite ends of the cushion 10*b*. The handles 28*b*, 30*b* are for transporting the cushion 10*b*. In the embodiment according to FIG. 5, one handle 28*b* is located on the side wall 24*b* adjacent the pillow 20*b* and the other handle 30*b* is located on the side wall 24*b* adjacent the body support 18*b* where the infant's feet would be located.

In this embodiment, the blanket 32*b* is completely removable and no part of the blanket is non-releasably attached to the side wall 24*b*. The blanket 32*b* is formed into a pocket and slides over the bottom half of the cushion 10*b*. The pocket shape of the blanket 32*b* encircles the cushion 10*b* to engage the bottom surface 16*b* of the base 12*b* and around the bottom half of the side wall 24*b*. Portions 34*b*, 36*b* of the blanket 32*b* and portions 35*b*, 37*b* of the side wall 24*b* are releasably secured together by Velcro™. The blanket 32*b* and the side wall 24*b* have mating portions secured together by Velcro™. The blanket 32*b* can be removed from the cushion 10*b* to wash the blanket separately from the cushion.

Similar to the embodiment shown in FIGS. 1–1*a* and 2–2*a*, the blanket 32*b* extends across the body support 18*b* up to the pillow 20*b* but does not extend over the pillow and the head of the infant when the infant is placed into the cushion 10*b* and covered by the blanket. The infant cannot pull the blanket 32*b* up over his/her head since it is secured to the side wall 24*b* by Velcro™ and is cut in the form of a pocket to a length which does not extend over the pillow 20*b*.

When placed into the portable infant cushion 10 of the present invention, the infant cannot unconsciously pull up the integral blanket 32 over its head. In addition, the infant cannot or roll underneath the integral pillow 20. The cushion 10 helps to prevent the infant from suffocating on the blanket or the pillow. Also, the blanket 32 cannot be pulled off of the infant to uncover the infant which can help to inhibit the infant from catching a cold.

Figure 6A:
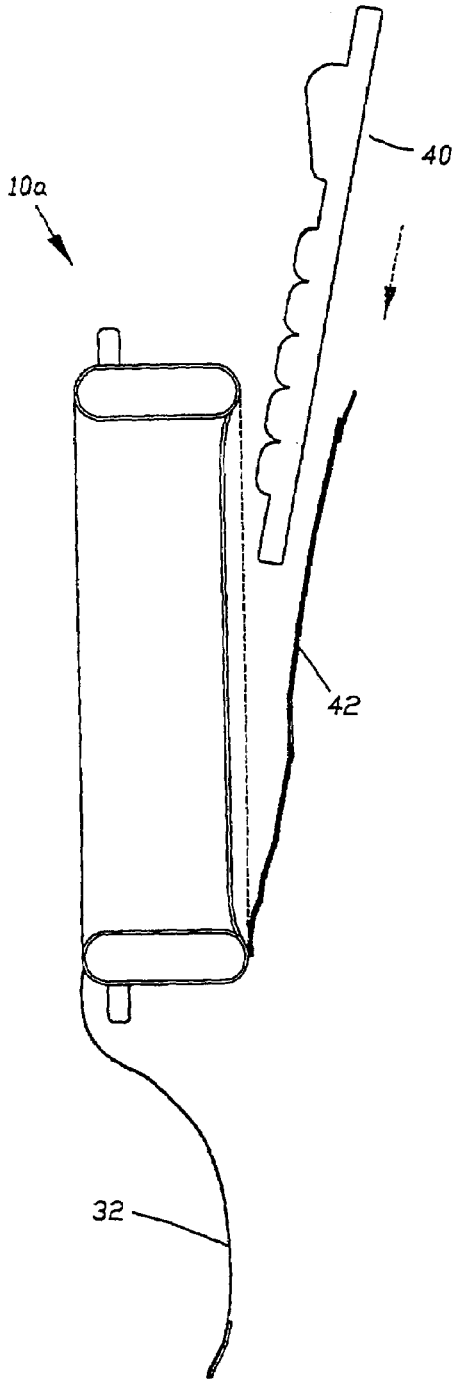
FIG. 6*a* is a cross-sectional view of the portable infant cushion taken along the lines 6*a*—6*a* of FIG. 6.
Figure 6:
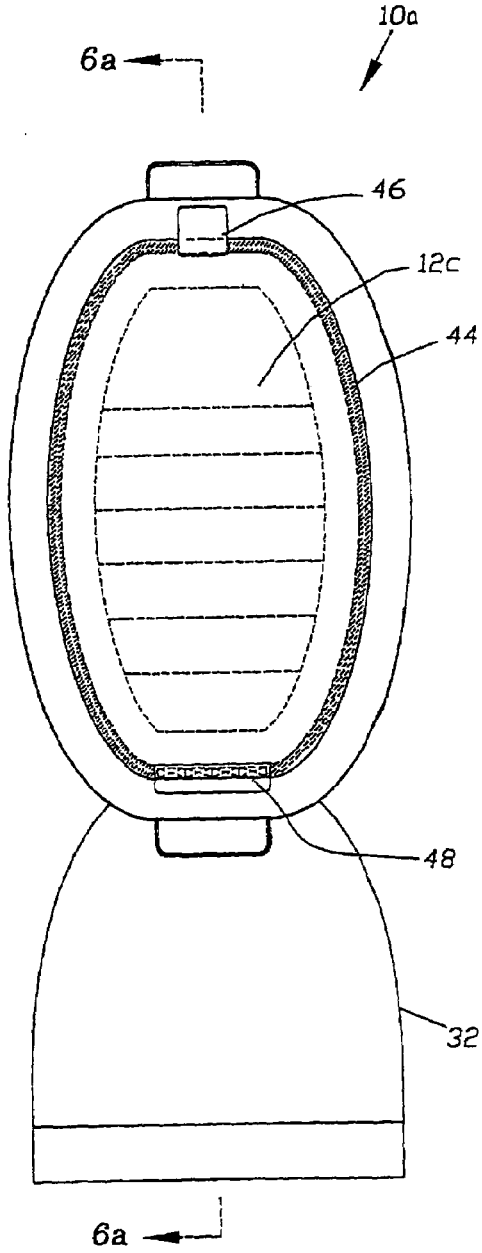
FIG. 6 is a schematic bottom view of a portable infant cushion according to a fourth embodiment with parts removed for clarity.

FIGS. 6–6*a* illustrate a fourth embodiment of the portable infant cushion. The cushion 10*c* is similar to the cushion 10 and parts that are the same or similar are given the same reference numerals with the suffix "c" attached. The infant cushion 10*c* has a generally oval shape.

The infant cushion 10*c* has a planar base 12*c* made of a one-piece layer of cushion material 40 inserted into a pocket 42. The pocket 42 has a Velcro™ or zipper closure 44 extending around the perimeter of the cushion 10*c*. A fabric tab 46 is attached to the zipper or Velcro™ closure 44 and is also releasably attached to the base 12*c* of the cushion 10*c*. The tab 46 facilitates opening the closure 44. It may be desirable to open the closure 44 to remove the cushion material 40, for example, for washing the cushion 10*c*. The pocket 42 is not completely removable from the cushion 10*c* because it is permanently attached to the base 12*c* at least at one section 48.

The cushion material 40 of this embodiment functions as the pillow 20 and body support 18 in the embodiment of FIG. 1 and can be manufactured of the same materials as the pillow 20 and body support 18. The particular thickness of the cushion material 40 can vary according to the manufacturer's preferences for achieving a desired degree of cushioning. In a particular example, the thickness of the cushion material 40 can be, but is not limited to, between 1–4 inches.

FIGS. 7–7*a* illustrate a fifth embodiment of the portable infant cushion. The cushion 10*d* is similar to the cushion 10 and parts that are the same or similar are given the same reference numerals with the suffix "d" attached. The infant cushion 10*d* has a generally oval shape.

The infant cushion 10*d* has a planar base 12*d*. The base 12*d* consists of two separate pockets 50, 52. The pocket 50 is for containing a layer of cushion material 54. The cushion material 54 functions as a pillow 20 similar to the embodiment of FIG. 1.

As viewed in FIG. 7, the pocket 50 has a longitudinally extending Velcro™ or zipper closure 58. The closure 58 extends along the middle of the pocket 50. However, the closure 58 can have any suitable location along the pocket 58 which facilitates removal and insertion of the cushion 54. In the embodiment of FIG. 7, the cushion material 54 is removable from the pocket 50 through the closure 58, for example, for washing the cushion 10*d*.

The cushion 54 is a preformed structure having a surface elevated and angled relative to the base 12*d* and having a shape generally conforming to the dimensions of the pocket 50. The cushion material 54 can have thickness which varies depending on the manufacturer's specifications. In one particular embodiment, the cushion material 54 can be, but is not limited to, between 1–4 inches thick.

The pocket 52 contains a separate layer of cushion material 56. Unlike the cushion material 54, the cushion material 56 is not removable from pocket 52. The cushion material 56 functions as a body support 18 similar to the embodiment of FIG. 1. The cushion material 54 and 56 can be manufactured from the same materials as the pillow 20 and the body support 18 similar to the embodiment of FIG. 1.

Although the cushion 10 is shown for insertion into a bassinet 100 in FIG. 3, the portable infant cushion can be advantageously inserted horizontally in a crib (not show) to provide a secure cushioned surrounding in which the infant cannot roll out of the cushion and into the crib slots. Instead of a crib, the portable infant cushion 10 can also be placed onto the floor, on top of an adult bed, into a stroller, baby buggy or car seat (not shown).

Another advantage of the portable infant cushion 10 of the present invention is that the ring insert 26 can be removed to vary the surface area of the top surface 14 on the base 12. Thus, the ring insert 26 enables the cushion 10 to adapt in size as the infant grows and enables the cushion to retain its usefulness as the infant grows.

Another advantage of the portable infant cushion 10 is that it provides the infant with emotional security and comfort. Infants naturally prefer to snuggle up to surfaces for physical support and for emotional security and warmth rather than be isolated and unsupported by any surface. The infant can sleep better and have a better disposition because the infant is well supported and comfortable in the portable infant cushion 10.

Figure 9:
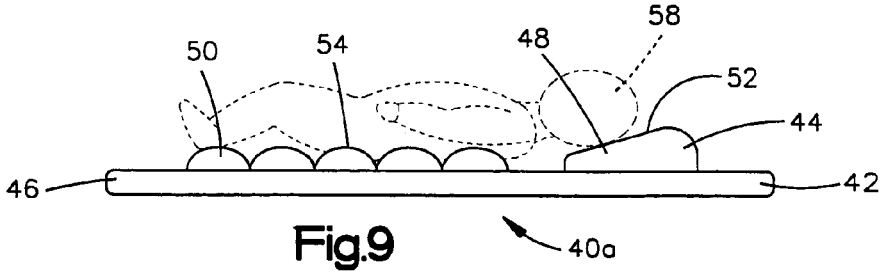
FIG. 9 is a cross sectional view taken along lines 9—9 of FIG. 8.
Figure 8:
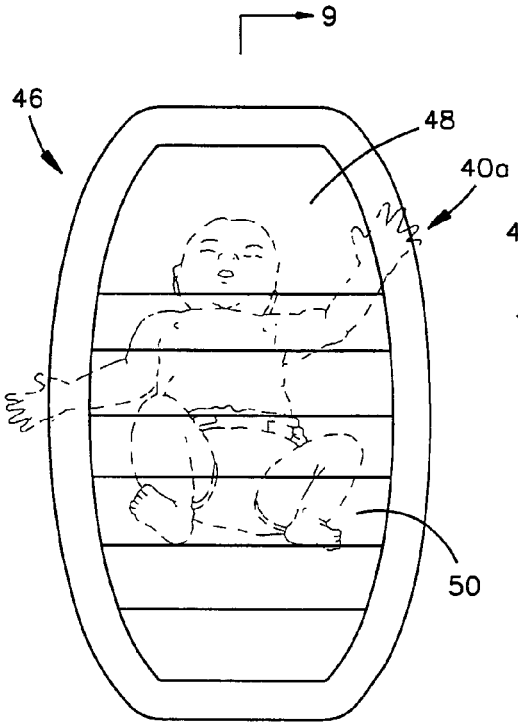
FIG. 8 is a schematic plan view of another embodiment of the portion of the portable infant cushion of FIG. 6*a;*

FIGS. 8–9 illustrate another embodiment of the cushion material 40 from FIG. 6*a*. The cushion material 40*a* is preferably a multi-layered structure including a first layer 42 made of hard material and a second layer 44 made of soft material overlying the first layer 42.

The hard material of the first layer 42 can be hard dense foam or lightweight plastic. Preferably, the hard material is inflexible and rigid and does not bend. The soft material of the second layer 44 can be memory foam or polyester batting encased in a cotton fabric shell. The cushion material 40*a* can also have a mattress construction such as a small child's mattress.

The first layer 42 of hard material comprises the base portion 46 of the multi-layered structure. The second layer of soft material comprises the pillow and body portions 48, 50. The pillow and body portions 48, 50 of the multi-layered structure are located in an overlying relationship to the base portion 46. The multi-layered structure of the cushion material 40*a* is a one piece unitary structure.

The pillow and body support portions 48, 50 are sewn onto the top surface of the base portion 46. Several sew lines are schematically illustrated on the body portion 50 in FIG. 8. The sew lines extend transverse to a longitudinal direction of the cushion material 40*a*. The body portion 50 is a half-oval shape. The pillow portion 48 is sewn to the top surface of the base portion 46 adjacent the body portion 50.

The pillow and body portions 48, 50 have elevated surfaces 52, 54 relative to the base portion 46. The surfaces 52, 54 of the pillow and body portions 48, 50 are for engaging an infant 58 to be placed onto the cushion material 40*a*.

The cushion material 40*a* is meant to also function as an accessory for other infant cushions or infant carriers (not shown). For example, most infant cushions and carriers are made entirely of a soft flexible material. If an infant is placed onto the entirely flexible cushion or carrier and transported, the entirely flexible cushion or carrier provides no supporting, rigid surface for stabilizing and safely transporting the infant. In other words, the entirely flexible cushion or carrier will flex and bend to conform to the body shape of the infant and the infant may be suffocated by a portion of the flexible cushion which overlies its face, when the infant rolls its head to contact the cushion.

This problem is overcome by the rigid and inflexible base portion 46 of the multi-layered structure cushion material 40*a* of the present invention. Since the base portion 46 is made of the hard material, the base portion 46 is rigid and inflexible and provides a stabile secure surface for transporting the infant without danger of the cushion material flexing into a position which may overlie the infant's face and suffocate the infant.

Figure 10:
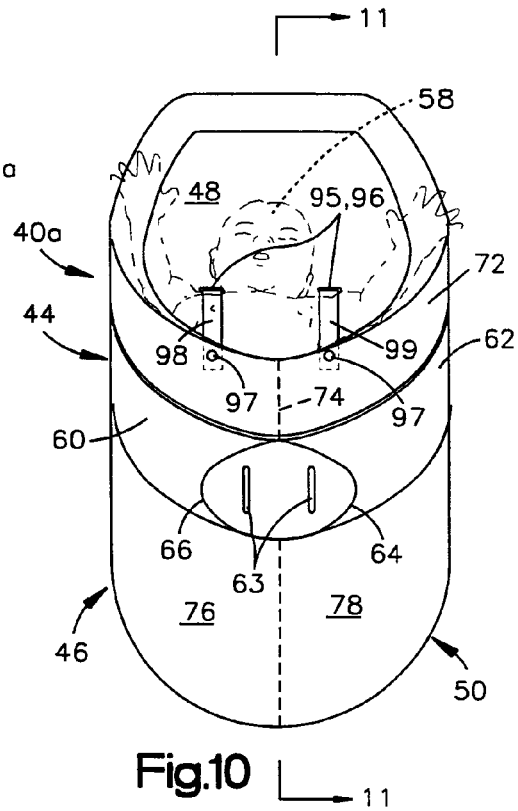
FIG. 10 is a schematic plan view of the portable infant cushion of FIG. 8 showing additional parts.
Figure 11:
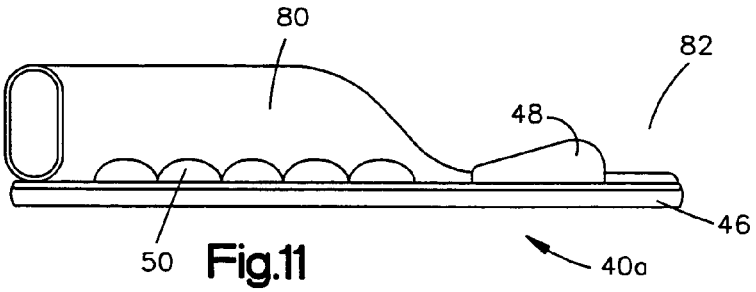
FIG. 11 is a cross sectional view taken along lines 11—11 of FIG. 10.

FIGS. 10–11 illustrate optional features of the cushion material 40*a*. The base portion 46 may include two optional integral flap structures 60, 62 extendable over the base portion 46 laterally in FIG. 10. The flap structures 60, 62 are for tightly wrapping around the infant 58 and for fastening to each other to secure the infant on the base portion 46.

The flap structures 60, 62 include terminal ends 64, 66. A fastening means 63 is located on the terminal ends 64, 66 for example, a hook-and-eye closure such as a strip of VELCRO™, or buttons or snaps. The flap structures 60, 62 can made of a soft material such as French terry cloth or a stretch fabric such as a LYCRA™ or SPANDEX™ blend with cotton or polyester.

The base portion 46 may include an integral blanket 72 for overlying the infant 58 and overlying only the body portion 50 of the second layer 44 of the multi-layered structure. The blanket 72 does not extend over the pillow portion 48 of the structure. When an infant is placed onto the pillow and body portions 48, 50 and is covered by the blanket 72, the infant's head is uncovered as illustrated in FIG. 10.

The blanket 72 may include a fastening means 74 which, when unfastened, bisects the blanket into two lateral blanket portions 76, 78. The fastening means 74 for the blanket 72 can be a zipper or VELCROT™. The flap structures 60, 62 extend over the blanket 72 when wrapped around the infant. The blanket 72 is a piece of fabric material such as French terry cloth, or other fabric material such as cotton, polyester, wool, fleece, or a combination thereof.

The base portion 46 may also include two shoulder straps 98 and 99 (FIG. 10). The straps 98 and 99 extend over the shoulders of the infant 58 to secure the infant in a position on the base portion 46. The straps 98 and 99 help prevent the infant from moving out of position on the base portion 46 such as sliding downward under the blanket.

The top edge of the straps 98 and 99 are attached to the underside of the base portion 46. The straps 98 and 99 extend through two slits 95 and 96 located near the infant's neck on opposite sides of the infant's head on the base portion 46. Alternatively, the top edge of the straps 98 and 99 may be attached to the base portion 46 in any suitable manner. Fasteners 97 attach the bottom edge of the straps 98 and 99 to the underside of the blanket 72. The fasteners 97 may be VELCRO™, buttons, snaps or any other suitable fasteners.

FIG. 11 illustrates an optional perimeter wall 80 connected to and encircling around only the body portion 50 of the multi-layered structure. The perimeter wall 80 does not encircle around the pillow portion 48 of the multi-layered structure. The perimeter wall 80 has terminal ends (only end 82 is shown in cross section) located between the pillow and body portions 48, 50.

The perimeter wall 80 is made of a hard and dense foam material. The perimeter wall 80 is not flexible and is rigid. The perimeter wall 80 can be either permanently sewn to the base portion 46 or can be releasably attached to the base portion 46 using a zipper or VELCRO™ or other suitable equivalent. The perimeter wall 80 is made of a hard material so that the infant cannot roll its head over to a position where the perimeter wall can overlie the infant's face and may suffocate the infant.

The entire cushion material 40*a* including the base, body and pillow portions 46, 48, 50 as well as the optional perimeter wall 80 can be encased in a fabric shell made of French terry cloth material, or other fabric material such as cotton, polyester, wool, fleece, or a combination thereof.

From the above description of the invention, those skilled in the art will perceive improvements, changes and modifications. For example, although the portable infant cushion 10 is illustrated as an oval shape, other shapes are contemplated such as square, circular or rectangular. In addition, although the blanket 32 is illustrated as a half oval, the blanket can have a square or rectangle shape. Further, although the handles 28, 30 are illustrated as one handle located at each of the opposite longitudinal ends of the side wall 24, other locations of the handles around the side wall are contemplated. In addition, a portable infant cushion having no handles is also contemplated. A cushion without handles is portable merely by securely grasping the bottom or side wall of the cushion. Such improvements, changes and modifications within the skill of the art are intended to be covered by the appended claims.

Having described the invention, the following is claimed:

1. A portable infant cushion comprising: a multi-layered generally planar solid structure including a base portion, and pillow and body portions overlying and connected to the base portion, said pillow portion having an elevated surface relative to the base portion, said body portion having an elevated surface relative to the base portion which surfaces are for engaging an infant to be placed onto said cushion, the multi-layered structure including a first layer of hard material and a second layer, overlying the first layer, of soft material, the cushion, when transporting the infant, being rigid and inflexible due to the hard layer of material, wherein said surface of said pillow portion is higher than said surface of said body portion relative to said base portion.

2. The portable infant cushion according to claim 1 wherein the hard material is selected from the group consisting of: hard dense foam and lightweight plastic.

3. The portable infant cushion according to claim 1 wherein the soft material is selected from the group consisting of: memory foam, and polyester batting.

4. The portable infant cushion according to claim 1 wherein the cushion is for use with another cushion unit and is located on the other cushion unit as an accessory cushion for providing additional support for the infant.

5. The portable infant cushion of claim 1 wherein said base portion includes a securing structure extendable over the base portion laterally, said securing structure having portions for tightly wrapping around the infant and for fastening to each other to secure the infant on said base portion.

6. The portable infant cushion according to claim 5 wherein the hard material is selected from the group consisting of: hard dense foam and lightweight plastic.

7. The portable infant cushion according to claim 5 wherein the soft material is selected from the group consisting of: memory foam and polyester batting.

8. The portable infant carrier according to claim 5 further comprising a wall of hard material connected to and encircling around the body portion of the multi-layered structure, the wall having terminal ends located between the body and pillow portions.

9. A portable infant carrier comprising: a multi-layered generally planar solid structure including a base portion, and pillow and body portions overlying and connected to the base portion, the pillow and body portions having elevated surfaces relative to the base portion which surfaces are for engaging an infant to be placed onto the cushion, the multi-layered structure including a first layer of hard material and a second layer, overlying the first layer, of soft material, the cushion, when transporting said infant, being rigid and inflexible due to the hard layer of material, the base portion including a securing structure extendable over the base portion laterally, said securing structure having portions for tightly wrapping around the infant and for fastening to each other to secure the infant on said base portion, wherein the base portion includes a blanket connected to a part of said base portion for overlying the infant and the body portion of the multi-layered structure.

10. The portable infant carrier according to claim 9 wherein the blanket includes a fastener which when unfastened, bisects the blanket into two lateral blanket portions.

11. The portable infant carrier according to claim 9 wherein the portions extend over the blanket when wrapped around the infant.

12. The portable infant carrier according to claim 11 wherein the portions include a fastener selected from the group consisting of: a hook-and-eye closure, buttons and snaps.

13. A portable infant carrier comprising: a multi-layered generally planar solid structure including a base portion, and pillow and body portions overlying the base portion, the pillow and body portions having elevated surfaces relative to the base portion which surfaces are for engaging an infant to be placed onto the cushion, the multi-layered structure including a first layer of hard material and a second layer, overlying the first layer, of soft material, the cushion, when transporting said infant, being rigid and inflexible due to the hard layer of material, the base portion including a securing structure extendable over the base portion laterally, said securing structure having portions for tightly wrapping around the infant and for fastening to each other to secure the infant on said base portion, wherein the base portion includes two shoulder straps for securing an infant placed onto the base portion and for helping to prevent the infant from moving around on the base portion.

14. A portable infant carrier comprising: a multi-layered generally planar solid structure including a base portion, and pillow and body portions overlying the base portion, the pillow and body portions having elevated surfaces relative to the base portion which surfaces are for engaging an infant to be placed onto the cushion, the multi-layered structure including a first layer of hard material and a second layer, overlying the first layer, of soft material, the cushion, when transporting said infant, being rigid and inflexible due to the hard layer of material, said base portion including a blanket connected to a part of said base portion for overlying the infant.

* * * * *